United States Patent [19]

Liljequist

[11] 4,253,303

[45] Mar. 3, 1981

[54] ENGINES, AND PARTICULARLY THOSE INCORPORATING THE STIRLING CYCLE

[76] Inventor: Jon L. Liljequist, 801 S. Elmhurst Ave., Mount Prospect, Ill. 60056

[21] Appl. No.: 80,566

[22] Filed: Oct. 1, 1979

[51] Int. Cl.[3] ..... F02G 1/04

[52] U.S. Cl. ..... 60/517; 92/44

[58] Field of Search ..... 62/6; 60/517-526; 92/34, 44

[56] References Cited

U.S. PATENT DOCUMENTS

| | | | |
|---|---|---|---|
| 2,567,637 | 9/1951 | De Brey et al. | 60/526 |
| 3,400,538 | 9/1968 | Winfrey | 92/44 X |
| 3,604,821 | 9/1971 | Martini | 60/526 X |

FOREIGN PATENT DOCUMENTS

| | | | |
|---|---|---|---|
| 1304829 | 1/1973 | United Kingdom | 60/517 |

OTHER PUBLICATIONS

*Stirling Engines,* by G. Walker; Oxford University Press, ISBN 0-19-856209-8, 1980.

*Primary Examiner*—Allen M. Ostrager

[57] ABSTRACT

An engine other than an internal combustion engine, and preferably one incorporating the underlying philosophy of the Stirling hot gas engine, is physically arranged to both significantly reduce its size and weight relative to earlier designs as well as reduce fluid leakage into or out of the engine's gas enclosure. Size and weight reduction are achieved in several ways including that of moving this disclosure's counterpart to the Stirling crankshaft from outside the working-gas enclosure to inside the working-gas enclosure, or at least closer thereto than in existing designs. In several embodiments of the invention, this rearrangement simultaneously eliminates a major source of fluid leakage. In some designs of this disclosure, the Stirling working-gas enclosure, which consists of a power piston and cylinder, are replaced by a somewhat different appearing and thoroughly sealed working-gas enclosure that includes a bellows, this also assisting in reducing weight. The Stirling displacer piston has also been modified both to improve efficiency and thus reduce weight. In one configuration it houses this invention's counterpart to the conventional Stirling crankshaft, in another embodiment it is driven by and assisted in its principal function by a rotating cam element, and in all embodiments it can be modified to direct the entrapped gas along different paths or routes depending on whether it is moving toward the hot end of the gas enclosure or toward the other end.

23 Claims, 12 Drawing Figures

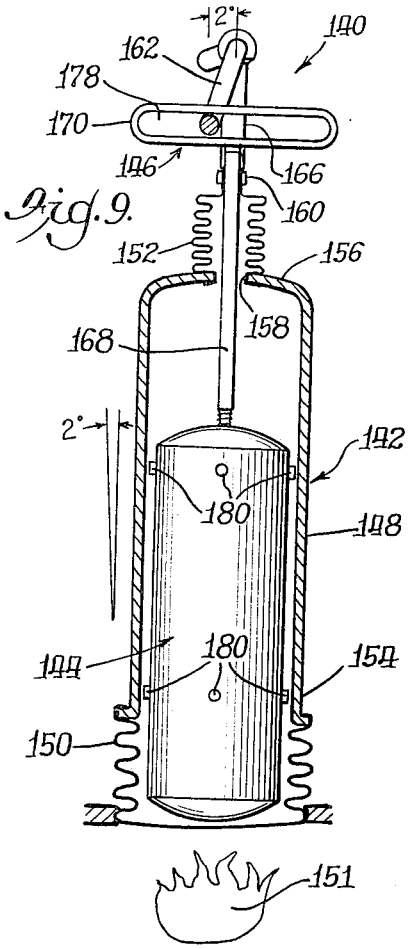
Fig. 9.
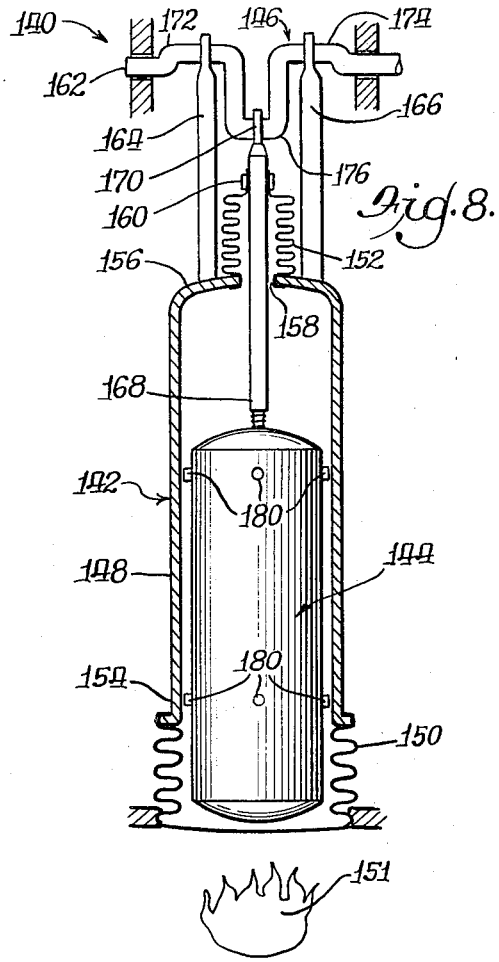
Fig. 8.
Fig. 12.
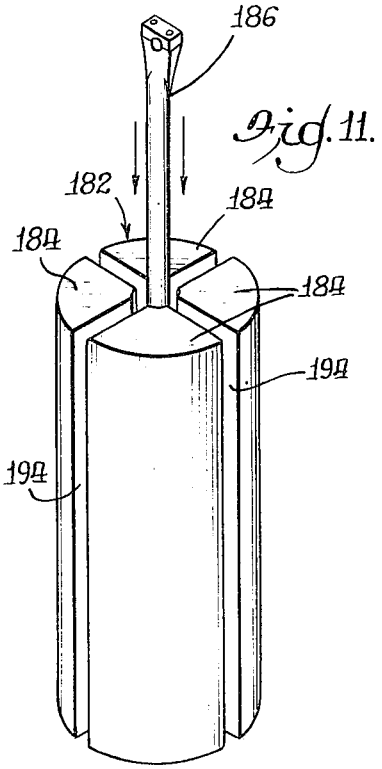
Fig. 11.
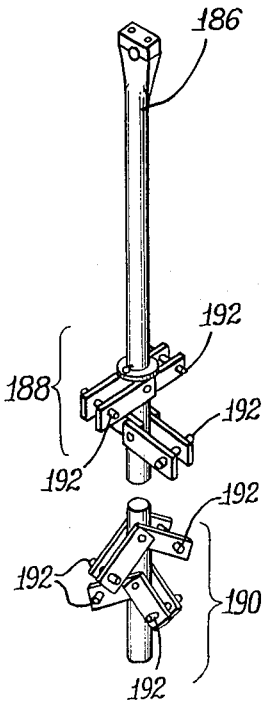
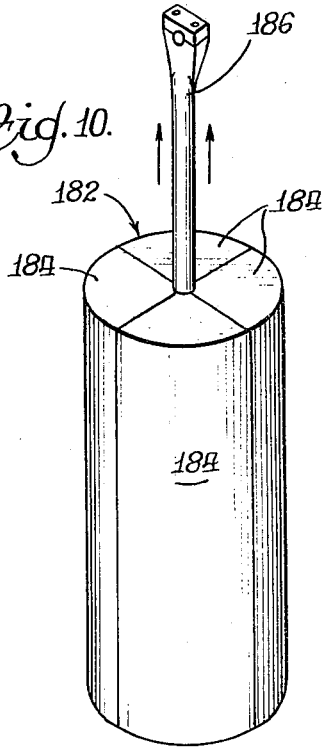
Fig. 10.

ENGINES, AND PARTICULARLY THOSE INCORPORATING THE STIRLING CYCLE

BACKGROUND OF THE INVENTION

The Stirling external combustion engine was invented by Robert Stirling over a century and a half ago. But although the engine principles he pioneered have occasionally been incorporated into various prime movers during the ensuing years, Stirling type engines still remain relatively unknown.

Within the past few decades, however, some degree of interest in the Stirling philosophy has been rekindled because a Stirling engine will operate on essentially any heat producing fuel or heat source. And, whereas the by-products of internal combustion engines are difficult to control, external combustion is relatively easy to adjust to minimize harmful by-products. Thus, two major problems in today's world, that of air pollution and the world's dwindling oil reserves, could be to some degree relieved by replacing the widely used internal combustion engine with engines incorporating the principles of Stirling's engine.

Although the basic Stirling configuration is well known in the literature, it will be described next in a cursory manner for the purpose of fixing terms so as to avoid confusion later when comparisons are drawn between it and the improvements of this disclosure. Terms used in the immediately following description are those normally associated with the various components of the basic Stirling engine configuration.

In essence, the Stirling engine comprises six basic parts in its simplest form. These are a main body including a cylinder, a power piston, a displacer piston, a crankshaft and two connecting rods. A heat source is also necessary, but it either may or may not be a part of the engine itself. The cylinder has a closed end and an open end, and the power piston and mating portions of the cylinder are both normally heavy castings machined to close fitting tolerances. Contained entirely inside the cylinder between the power piston and the cylinder's closed end is the displacer piston. Presuming for simplicity that a regenerator is not employed, the displacer piston usually fits quite loosely in the cylinder so that air or other gas also contained in the cylinder is relatively free to flow around it as it reciprocates within its confines. Considerably outboard beyond the open end of the cylinder is the crankshaft. Its rotational axis is perpendicular to, and intersects with, an extension of the cylinder's longitudinal axis. This crankshaft includes two connecting rod cranks angled about 110° apart when viewed down its own centerline or rotational axis. One of the connecting rods connects one crank to the power piston, and the other connecting rod connects the other crank to the displacer piston. But because the power piston is disposed directly between the displacer piston and the crank to which it is connected, the connecting rod for the displacer piston extends through an axial center hole in the power piston. The crank to which the power piston is connected is closer to the crankshaft's rotational axis than is the crank to which the displacer piston is connected. Thus, the displacer piston has a relatively long stroke while the power piston has a relatively short stroke. The approximate 110° angle between crankshaft cranks causes an unusual movement pattern between the two pistons not unlike the action of that toy known as a "yo-yo" in conjunction with the hand of a person operating it.

The operation of the Stirling engine is well known to those skilled in the art, and so a detailed explanation of its operation will not be detailed herein. Suffice it to say that the displacer piston separates the entrapped gas in the cylinder into two variable volume portions or chambers. Presuming again the simplest Stirling configuration without a regenerator, one of these is the expansion space at the cylinder's closed end adjacent the heat source, and the other is the compression space adjacent the power piston. As the gas in the expansion space is heated, the displacer piston moves toward the cylinder's closed end and forces that heated gas around it into the compression space where its now increased pressure bears against the power piston and moves it outwardly which is its power stroke. Expansion of the gas in the compression space accompanies a reduction in its temperature, and as the piston reverses its direction and embarks upon its return stroke, the displacer piston moves to nearly meet it and force the entrapped gas therebetween back around it into the expansion space. On its journey to the expansion space, it is cooled by the cylinder's inner sidewall. These two strokes comprise a complete engine cycle.

Early Stirling designs incorporated very few parts and were thus particularly uncomplicated. However, the transfer of heat from an external source through a solid wall to heat gas in the cylinder did not lend itself to achieving high torque output characteristics, and the squeezing of gas around the displacer piston back and forth did not permit high rotational speeds to be attained, thus holding down power output. Yet, periodically the Stirling engine is re-examined because of the increasing need for engines of inherently non-polluting characteristics capable of burning fuels other than those derived from petroleum. To enhance the engine's poor power and torque output, many modifications to Stirling's basic design concept have been proposed and tested. Usually these modifications complicate the design and increase both in size and weight an engine already considered by many to be too large and heavy for its output.

For example, it has been found that replacing the entrapped air with a more heat conductive gas, such as helium, both increases performance as well as provides output control when the gas pressure can be varied. Unfortunately, increasing the internal gas pressure poses tricky sealing problems. In solving this problem, one experimental group devised a crankshaft arrangement they named "Rhombic Drive" that permitted the two connecting rods to be arranged concentrically and move in a purely reciprocating manner. This is conjunction with a specially designed seal they publicized as a "Roll Sock" that fit over the connecting rods reportedly held the pressurized gas effectively within the cylinder. Other more exotic Stirling engine improvements or variations also have been written up. One of these, the "Rinio", groups four cylinders together and channels the internal gas back and forth between several cylinders. This completely eliminated the displacer pistons, and this "second generation" design has been described as holding great promise for the future of the Stirling concept. Yet, for reasons of efficiency, size, cost, power, torque or whatever, the excitement that accompanied each engineering breakthrough appears to have subsided, and Stirling engines continue in relative obscurity.

It is this background that set the stage for, and utilimately precipitated, the engine improvements to be described in detail hereinafter.

SUMMARY OF THE INVENTION

The engine improvements to be described comprise a significant departure from the physical configuration of the original Stirling design described above. And because many of the components in the improved design of this disclosure either appear or function somewhat differently from their counterparts in the basic Stirling design, somewhat broader terms will be applied to the components of this disclosure for identification and comparison purposes.

To begin with, the cylinder and power piston of the conventional Stirling engine are replaced at least in some embodiments with a flexible, but fully sealed, "working-gas enclosure" or more simply "gas enclosure" having a "base portion" and a "power reciprocator" portion. The displacer piston is shown in several of its many possible forms ranging from one quite similar to the basic Stirling design to another which is assisted by a rotating element. One even changes shape to provide two different routes for the entrapped gas flow, depending on whether the gas is moving toward the heated end of the enclosure or toward the other or working end. Thus, herein, that component having as its function, or having as one of its functions, the moving of the entrapped gas successively to opposite ends of the gas enclosure to first cause it to be heated and thereafter permit it to expand against the power reciprocator is termed the "displacer means". Finally, although the crankshaft of the original Stirling engine always comprises the mechanical power output, this is not uniformly true of every embodiment of this invention. Since its counterpart in this disclosure always interrelates the movement of the power reciprocator relative to the movement of the displacer means, it and its associated mechanism will simply be referred to as "interconnecting means" in the improved engines to be described.

Although all of the new designs described herein include improvements to get more power from physically smaller and lighter designs, some combinations of features will produce exceptionally light weight engines while others lend themselves to somewhat more substantial installations. When used for the generation of electrical energy, large installations could tap heat energy from natural heat banks or thermal layers both on land as well as at sea. But even more exciting are these engines' potential for running electrical generators from solar energy.

An important aspect of the invention lay in its physical arrangement of parts that inherently lends itself to being sealed. Sealing keeps corrosives and other contaminants out of the engine to keep efficiency up, extend engine life, protect the interconnecting mechanism, and also to permit it to be used in a variety of environments including those that are quite hostile to mechanical operations. It also keeps the entrapped gas within the enclosure so that it will not escape and dissipate in the outside atmosphere. Thus, if helium or some other highly conductive gas is employed in the gas enclosure, it neither escapes nor becomes diluted by the influx of fluids best kept out. And, of course, effective sealing permits the gas enclosure to be pressurized if that is deemed desireable in a given engine application. As will be seen, several of the embodiments of the invention to be described are inherently thoroughly sealed.

In the basic Stirling design, there are normally two places where the entrapped gas can escape. One of these is between the cylindrical periphery of the power piston and the cylinder, and the other is where the displacer-piston-connecting-rod extends through the power piston. Other and more recent Stirling designs may have other areas of potential leakage, such as, for example, where the crankshaft exits the engine block.

Leakage around the power piston (or "blow-by") is avoided herein in several representative embodiments of the invention by replacing the power piston and cylinder with a completely sealed yet flexible gas enclosure. This gas enclosure is expandable and contractable because at least part of its sidewall comprises a flexible element forming a part of, or sealingly affixed to, the rest of the gas enclosure. In practice an ordinary bellows can be employed, and when employed the ramifications are considerable. Because, whereas early Stirling designs required a precision machined and thick walled cylinder to mate with a precision machined and heavy power piston, neither of these heavy components is necessary if a bellows is employed, although there may be other design considerations making a rather heavy piston desireable. And, because a bellows is by design preferably both thin walled and of large surface area (due to its interfolded pleats or flutes), it is an excellent heat conductor. It can be employed anywhere along the gas enclosure from the latter's heated end to its other extremity, in several places in a given design, or even continuously. Beyond axial flexibility it also has lateral flexibility, and the latter is used advantageously in the third of the representative designs set forth in the drawings.

The other major source of fluid leakage occurs where the displacer-piston-connecting-rod extends through the power piston, and this leakage problem is simply eliminated in several embodiments of the invention in conjunction with further reducing the size and weight of the engine, this being another major and interrelated aspect of the invention, to be described next.

As mentioned earlier, the basic Stirling configuration includes an "outboard" crankshaft spaced a considerable distance axially beyond the open end of the cylinder. And because most Stirling engines in the past have been built up around a cast engine block, an outboard crankshaft considerably expands the size, and therefore the weight, of that engine block and the resulting assembled engine. Yet, to simply reduce this distance only to conserve on size and weight creates other problems such as, for example, it increases the side forces acting on the pistons.

In the improved designs of this disclosure the problem is solved by moving the "interconnecting means" (this disclosure's counterpart to the Stirling crankshaft and associated mechanism) inboard, or completely inside the gas enclosure in several designs. By moving the interconnecting means inboard, the displacer-means-connecting-rod also moves entirely inboard, thus eliminating the axial center hole in the power piston and the gas leakage that accompanies it. Other advantages also flow. With the gas enclosure sealed, and because no internal combustion occurs therein, the interconnecting means stay free of corrosion and contamination.

Thus, interrelated advantages flow from seemingly non-related improvements. Compacting the engine by incorporating inboard "interconnecting means" creates many advantages including eliminating a source of leakage, while sealing off the gas enclosure around the power reciprocator with a bellows may also lighten the engine considerably. If thorough sealing is the primary concern, it serves little purpose to effectively seal all points of potential leakage save one. Truly there is a synergistic effect in incorporating both improvements simultaneously. However, this is not to say that these two major improvements necessarily must be used together because each is of enormous value in its own right.

Several variations of displacer means are shown in the drawings. One of these utilizes the otherwise lost space within the displacer means by mounting the interconnecting means therein. Another uses a reciprocating displacer that is assisted by another displacer that happens to be part of the interconnecting means, in this case the crankshaft. Yet another arrangement discloses the concept of changing the shape or configuration of the displacer means to provide different paths for the entrapped gas depending on whether the gas is moving toward the heated end of the gas enclosure or toward the power reciprocator. And while these displacer means variations are shown separately for ease of description and understanding, it will be appreciated that certain variations of different displacer means could be grouped together in a single design.

Mechanical power can be tapped or withdrawn from these engines in several ways not different from most known engines. Reciprocating power can be tapped directly from external portions of the power reciprocator, rotary power can be tapped directly from the interconnecting means in several embodiments, and in one of the latter, a rotary output across a sealed wall could be achieved with a magnetic coupling.

The number of designs that could be devised from these teachings are numerous. In the interest of brevity, however, only three variations have been shown in the drawings. They are believed to be representative of the basic, underlying inventive concepts of this disclosure and were selected only to illustrate those concepts. It is not intended that the invention be limited to those specific designs or even combinations thereof.

DESCRIPTION OF THE DRAWINGS

FIG. 8 is a front elevation in cross section of yet another design embodying aspects of the present invention.

FIG. 9 is a side elevation in cross section of the embodiment of the engine shown in FIG. 8.

FIG. 10 is a perspective view of a modified displacer means that can be used to replace the displacer means of FIGS. 8 and 9, here shown as it appears moving away from the heat source.

FIG. 11 is a perspective view of the displacer means shown in FIG. 10, here shown in a configuration expanded from that of FIG. 10 as it moves toward the heat source.

FIG. 12 is a perspective view of the central control shaft that controls the expansion and contraction of the displacer means shown in FIGS. 10 and 11.

DESCRIPTION OF SPECIFIC EMBODIMENTS

Figure 1:
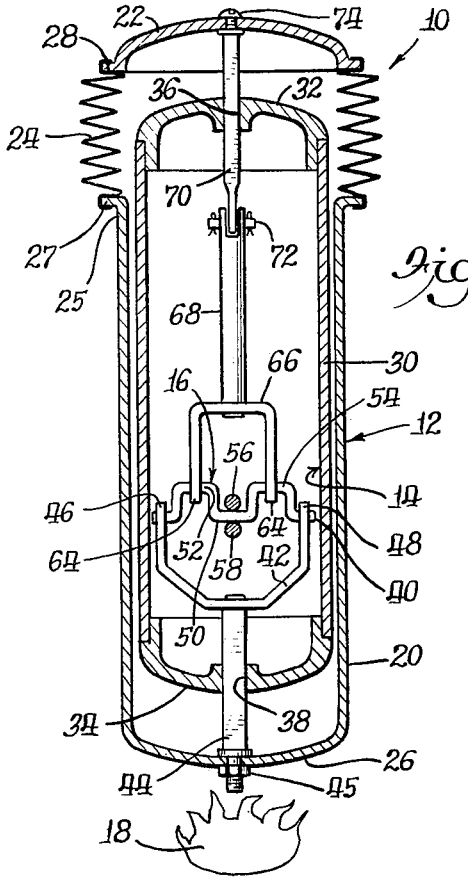
FIG. 1 is a front elevation in cross section of an engine embodying certain of the principles of this invention.
Figure 2:
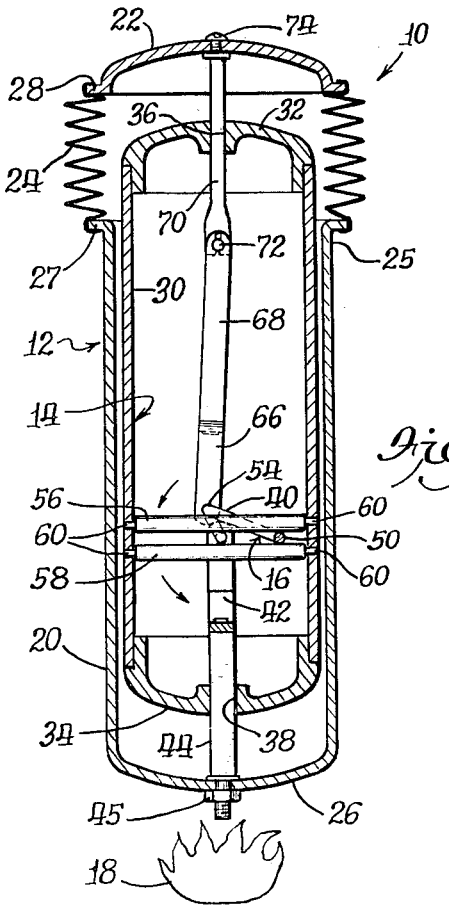
FIG. 2 is a side elevation in cross section of the engine shown in FIG. 1.
Figure 3:
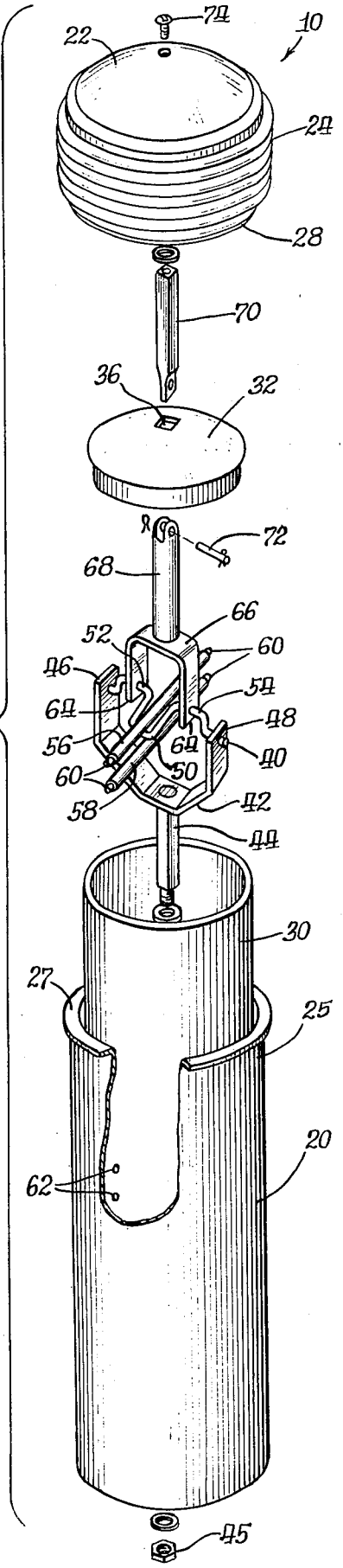
FIG. 3 is an exploded perspective view of the engine shown in FIGS. 1 and 2.

Referring now generally to FIGS. 1 through 3, and particularly to FIGS. 1 and 2, there is shown an engine designated generally 10 having several major components including an expandable and contractable gas enclosure designated generally 12, displacer means designated generally 14, and interconnecting means designated generally 16. Depending upon the ultimate use of the engine, a heat source 18 will either be included as an integral part of the engine 10, or alternatively it will be a part of some other heat source from which the improved design will tap energy.

Expandable enclosure 12 includes a base portion 20, a power reciprocator 22, and also flexible means shown here in the form of a bellows 24. Base portion 20 is shown here as being of generally hollow cylindrical shape having an open end 25 and a closed end defined by an end wall 26 proximate heat source 18. The extreme end portions of open end 25, as well as the lateral outermost extremities of power reciprocator 22, are lipped as at 27 and 28 respectively to facilitate the attachment and sealing of bellows 24 thereto. As will be understood, bellows 24 permits expansion and contraction of gas enclosure 12 under the application of forces tending either to axially separate or bring together base portion 20 and power reciprocator 22. It will also be understood that power reciprocator 22 could be an integral part of the bellows in light duty applications, or alternatively, the entire base portion 20 (which preferably also is constructed of a thin wall and highly heat conductive material) could have the bellows formed integrally therewith as a single piece, and the power reciprocator would be the closure member for the gas enclosure.

Displacer means 14 is a hollow and closed ended cylinder including a central, tubular portion 30 and a pair of end caps 32 and 34 pressed into or otherwise rigidly attached to the opposite ends of tubular portion 30. End caps 32 and 34 each have a centrally located and square shaped hole therethrough, these being designated 36 and 38 respectively, and their function is in part to angularly key the displacer means 14 with mechanism contained therein.

Interconnecting means 16 includes a crankshaft 40 supported by a stationary yoke 42 affixed to a rigid and stationary stanchion 44. Stanchion 44 has a square cross section that closely fits with, and extends through, the square hole 38 in displacer means end cap 34. The other end of stachion 44 could be brazed onto the inside of end wall 26, but instead it is shown here extending through end wall 26 where it is drawn up tightly with fastening means 45 against a sealing gasket to form a seal, preferably hermetic. Thus, yoke 42 is fixed relative to base portion 20, and it rigidly supports the interconnecting means 16 entirely inside displacer means 14. It further serves to center displacer means 14 laterally within the gas enclosure, yet displacer means 14 are free to reciprocate longitudinally thereof.

The outermost ends of crankshaft 40 are journaled in the distal ends 46 and 48 of yoke 42, and therebetween lie cranks 50, 52 and 54. Center crank 50 drives displacer means 14 by way of connecting means in the form of a Scotch yoke formed by a pair of transverse and parallel rods 56 and 58 extending across the diameter of hollow displacer means 14. Rods 56 and 58 have reduced diameter ends 60 that are assembled into mating holes 62 (see FIG. 3) in the displacer means tubular portion 30. Rods 56 and 58 are constrained to remain perpendicular to the rotational axis of crankshaft 40 because displacer means 14 is keyed to stanchion 44 by way of square hole 38 in end cap 34 that mates with the square cross section of fixed stanchion 44.

Cranks 52 and 54 are connected to the bifurcated ends 64 of a yoke portion 66 of the power-reciprocator-connecting-rod that also includes shaft 68 rigidly attached thereto. Although no details are presented in the drawings, various well known techniques of connecting yoke 66 to cranks 52 and 54 can be employed such as, for example, those used in internal combustion engines. Shaft 68 at its end opposite yoke 66 is pinned for relative angular motion to another shaft 70 by means of a pin 72. As with stanchion 44, shaft 70 has a square cross section also, and it extends through the square hole 36 in end cap 32 of the displacer means up to engagement with the middle of the inner surface of power reciprocator 22. Although it could be brazed or otherwise permanently bonded to that surface, it is instead tapped and sealingly fastened thereto by means of a screw fastener 74 that draws the shaft up tightly against a gasket and fixes the shaft angularly. Shaft 70 serves several functions including those of centering the displacer means transversely at the power reciprocator end of the gas enclosure as well as assisting in keying the interconnecting means and displacer means angularly relative to one another by virtue of the square hole 36 and the square cross section of shaft 70.

The offset ("throw") of cranks 50, 52 and 54 relative to the rotational axis of the crankshaft 40, and the angular displacement of crank 50 relative to cranks 52 and 54 (looking down the crankshaft rotational axis), is in keeping with well known and sound Stirling principles. And because the thermodynamics of the improved design fairly closely parallels those pioneered by Robert Stirling, a discussion of how his design converts heat energy to mechanical energy will not be presented here. Rather, the mechanical superiority of these designs and what they achieve will be emphasized.

Having no sliding or rotary seals, the gas enclosure of FIGS. 1 through 3 is impervious to the gain or loss of internally entrapped gas, and it will even hold gas under pressure. Contaminants outside the gas enclosure are effectively sealed out to prevent internal corrosion, to prevent dilution of entrapped gas, or other fouling of the interconnecting mechanism contained therein. The otherwise unused and thus wasted volume inside the displacer means is utilized to diminish the overall dimensions of the engine, thus conserving on size and weight and material cost. At the same time, the interconnecting means operate both in an ultra-clean environment and one unable to replenish itself with corrosives. A hole through the power piston or power reciprocator is either unnecessary, or if employed, is hermetically or otherwise sealed off to thus eliminate a leakage problem, the cost of machining a close fitting or mating hole, and ultimate wear between it and the connecting rod extending therethrough. Internal alignment between displacer means and interconnecting means is simply and effectively maintained, as well as centering of the displacer means within the gas enclosure, by shaft 70 and stanchion 44. The displacer means is free to reciprocate on shaft 70 and stanchion 44, yet these close mating parts reasonably effectively avoid a cyclical transfer of entrapped gas into and out of the displacer means which might otherwise affect the thermodynamic workings of the improved engine. Heavy cast parts can be employed where the output of the engine is substantial, but otherwise, inexpensive light and simple parts of sheet metal and rod stock, and perhaps a few molded parts, are ample.

Reciprocating power can be tapped directly from the outer surface of the power reciprocator to run pumps or push rods or the like, or a connecting rod can be pivotally installed externally on the power reciprocator to turn an external crankshaft. And as occasionally occurs with hot gas engines, if the internal interconnecting means come to rest at a dead-center position (from which the engine is difficult to start once again), fastening means 45 and 74 can be loosened to provide sufficient axial play for both stanchion 44 and shaft 70 to permit an engine servicer to work them out of that dead-center condition.

Because several engines can be linked together for more output, and because an auxiliary and external crankshaft might be employed, these variations from what has been shown in the drawings may dictate placement of a flywheel. Thus, no flywheel has been shown in any engine designs described herein, however an excellent place for a flywheel is naturally as a part of, or connected to, the crankshaft.

Figure 4:
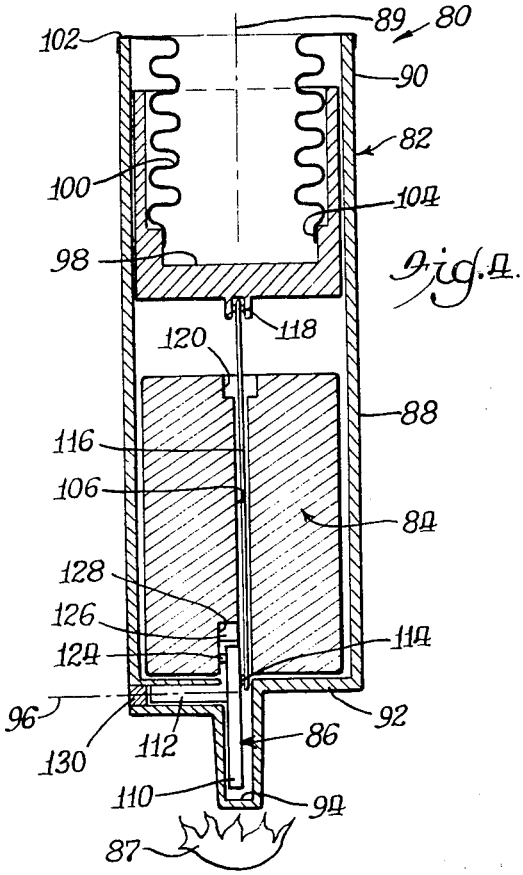
FIG. 4 is a front elevation in cross section of another embodiment of the present invention.
Figure 5:
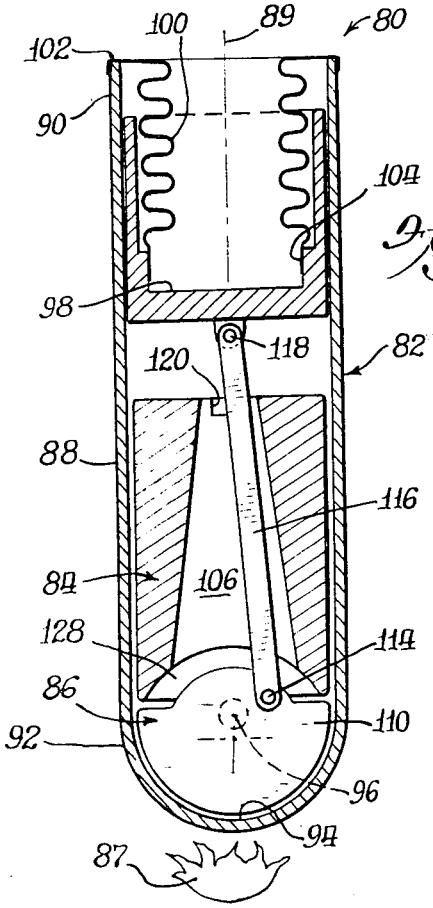
FIG. 5 is a side elevation in cross section of the embodiment of the invention shown in FIG. 4.
Figure 6:
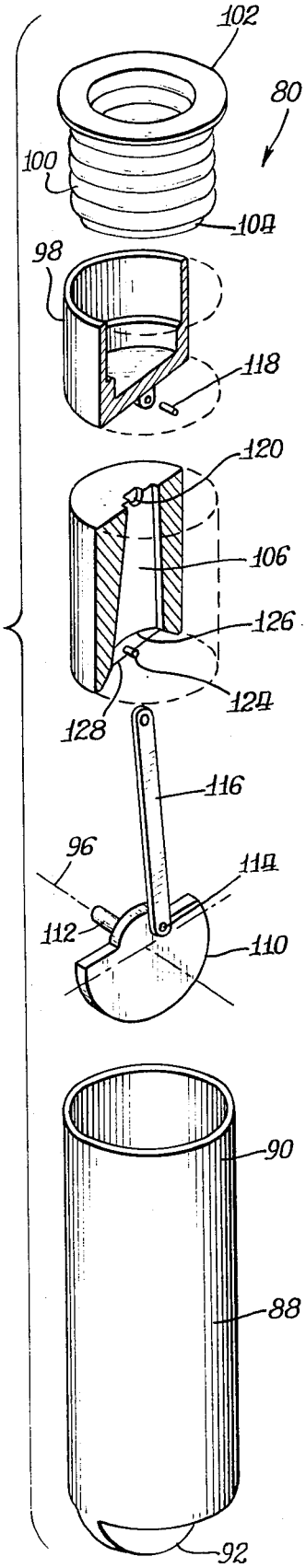
FIG. 6 is an exploded perspective view of the embodiment of the invention shown in FIGS. 4 and 5, portions cut away to more clearly show certain internal details.

Referring next to FIGS. 4 through 6, there is shown a different engine embodiment of the invention, and herein this engine is designated generally 80. As indicated in FIGS. 4 and 5, engine 80 includes a gas enclosure designated generally 82, reciprocating displacer means designated generally 84, and interconnecting means designated generally 86. However, as will become apparent, part of the interconnecting means also comprise a part of the displacer means. And, as with the embodiment of FIGS. 1 through 3, a heat source 87 at one end of the gas enclosure 82 can either be carried with the engine, or alternatively, the engine can tap heat from some other source.

Gas enclosure 82 includes a generally cylindrical base portion 88 having a longitudinal axis 89, an open end 90 and a closed end formed by an end wall 92. End wall 92 is defined in part by an axially outwardly curving fin that envelops an internal and semi-circular slot 94. As will be described shortly in more detail, a key element of the interconnecting means rotates in slot 94 about an axis 96 which is perpendicular to longitudinal axis 89.

Gas enclosure 82 also includes at its other end a power reciprocator 98, and also flexible means in the form of a bellows 100. Preferably the clearance between power reciprocator 98 and the inner sidewall of fixed portion 88 is held to a minimum. To thoroughly seal the gas enclosure from the outside environment, bellows 100 is sealingly attached (preferably hermetically) at one of its ends 102 to the open end of cylindrical base portion 88, and at its other end 104 it is attached to power reciprocator 98. Although no gas can escape gas enclosure 82 freely, the close fit between cylindrical base portion 88 and power reciprocator 98 still minimizes the passage of entrapped gas back and forth around power reciprocator 98 to ensure that the operation of the improved engine 80 parallels the Stirling philosophy.

As with basic Stirling designs without regenerators, the displacer means 84 are of somewhat lesser outer diameter than the inner diameter of cylindrical base portion 88 to permit entrapped gas to flow therearound, and it also contains a central slot 106 extending axially therethrough as well as several other sculptured hollows to provide relief for other portions of the interconnecting means, to be described next.

In general, interconnecting means 86 comprises all of the parts or mechanism that appropriately links the new and improved engine together so that it can move and function in keeping with the Stirling concept. One of the key elements of interconnecting means 86 is this embodiment's counterpart to the Stirling crankshaft, and herein it comprises cam-shaped combination element 110 disposed for rotation in end wall slot 94 about its own shaft 112. Shaft 112 extends transversely outwardly from combination element 110 to one side only, its own longitudinal axis coinciding with transverse axis 96, and outwardly from its other side juts a crank pin 114 offset from rotational axis 96. As will become apparent, combination element 110 interconnects the power reciprocator 98 with the displacer means 84 by way of a pair of connecting means of which one comprises a connecting rod and the other comprises a positive cam track and cam follower.

Figure 7:
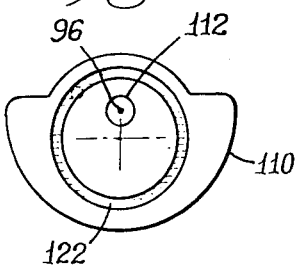
FIG. 7 shows the side of one element forming a part of the embodiment of FIGS. 4 through 6, the side shown being the other side than that seen in FIGS. 5 and 6.

Journaled on crank pin 114 is the crank end of the power-reciprocator-connecting-rod 116. Connecting rod 116 extends from crank pin 114 through slot 106 in displacer means 84 to its other end which is pinned at 118 to the middle of the inner surface of power reciprocator 98. Relief in the form of an indentation 120 is provided in the end of displacer means 84 for receiving pin 118 at those cyclical times of close approach. Element 110 is thus driven by power reciprocator 98 and, as will be seen, in turn drives displacer means 84. In driving the displacer means, combination element 110 acts as a positive cam. Formed in the same side of element 110 as that from which shaft 112 eminates is a positive cam slot 122 (see FIG. 7) that cooperates with a follower pin 124 pressed into and jutting out of displacer means 84. This follower pin 124 is disposed in a cut-away portion 126 of the displacer means at its central, expansion space end. Portion 126 is cut away to provide relief for the rotation of cam-shaped element 110. The sidewall 128 of cut-away portion 126 is flat and in close proximity to the adjacent side face of element 110 to thereby maintain a fixed angular orientation between element 110 and displacer means 84 relative to longitudinal axis 89.

Combination element 110 not noly interconnects and properly interrelates the movement of the power reciprocator 98 with the displacer means 84 according to the Stirling approach, this being achieved by the proper placement of the crank pin 114 and the positive cam slot 122, but it also acts to assist displacer means 84 in driving heated gas out of the heated end of the gas enclosure. FIGS. 4 and 5 show element 110 and displacer means 84 in their lowermost or "bottom dead center" position when the bulk of the expansion space is filled therewith, thus putting the heating chamber in its minimum volume condition. If element 110 were to be rotated 180°, this would drive the displacer means to its "top dead center" position, and this would open up a significant volume for gas to enter and be heated, including much of the volume comprising slot 94 that was formerly consumed by the bulk of element 110. Thus, both the primary displacer means 84 and combination element 110 cooperate in the gas displacement process.

As with the embodiment of FIGS. 1 through 3, gas enclosure 82 is sealed (preferably hermetically) from the outside atmosphere, and the interconnecting means are carried entirely inboard, with all of the same resulting advantages. Size and weight are diminished, internally entrapped gases stay inside, contaminants stay outside both to avoid internal corrosion as well as to eliminate fouling of the internal mechanism, and so forth. A larger and heavier power reciprocator was employed in this particular design in order to show a heavier duty engine, and this does tend to lengthen out cylindrical base portion 88 somewhat. On the other hand, placement of shaft 112 of the crankshaft counterpart at the extreme opposite end from the power reciprocator has somewhat the reverse effect and tends to diminish the engine's profile. If one chose to replace the power reciprocator and bellows of this embodiment with the power reciprocator and bellows of the embodiment of FIGS. 1 through 3, a particularly short and light construction would result.

Use of a cam to drive the displacer means has some interesting ramifications. Instead of the displacer means being limited to a modified sinusoidal movement as it would be if driven by a connecting rod, the positive cam slot 122 can be experimentally modified in shape to create the most efficient displacer means movement for a given engine design.

Power can be tapped from new and improved engine 80 in the same ways as in the earlier described embodiment, or rotary power can be taken directly off shaft 112. This would be accomplished by providing the engine with a substantially longer shaft 112 than shown. This modification is achieved quite simply by removing a sealing plug 130 and inserting a longer shaft 112 into combination element 112 from outside the gas enclosure. Element 110 and shaft 112 can be made to either screw together or key together entirely from the outside, and thus the change in power take-off can be made after the engine has been placed into service and is operational in the field. To prevent leakage around an extended shaft 112 that extends from inside to outside the gas enclosure, provision (not shown) can be made for any one of a number of commercially available rotary shaft seals where the shaft exits the gas enclosure. Some of these seals are even effective for containing pressure, but if for some reason this is not deemed satisfactory, then some form of magnetic coupling across the sidewall of the gas enclosure will definitely prevent gas leakage. For example, and although not shown in the drawings, one could extend shaft 112 to outside base portion 88, key a magnetized flywheel to the outer end of the shaft, sealingly enclose these otherwise exposed elements against base portion 88 to eliminate gas leakage, and use the rotating and magnetized flywheel to magnetically couple to an outboard driveshaft.

Referring now to FIGS. 8 and 9, the engine of this variation is designated generally 140 and includes a gas enclosure designated 142, displacer means designated generally 144, and interconnecting means carried generally outboard of the gas enclosure and designated generally 146.

Gas enclosure 142 includes an elongate, cylindrically shaped and hollow power reciprocator 148, flexible means in the form of a relatively large bellows 150 proximate the heat source 151, and a relatively small bellows 152. The larger bellows 150 is generally cup shaped with fluted sidewalls and a closed over bottom adjacent the heat source, this bottom comprising the base portion of gas enclosure 142.

Power reciprocator 148 includes an open end 154 at the expansion space end of the gas enclosure, and it also includes a substantially closed end 156 adjacent the compression space end of the gas enclosure. Small bellows 152 serves to seal a small, central hole 158 through closed end 156 of the power reciprocator 148. Hole 158 in this embodiment is necessary in linking the displacer means 144 to the rest of the interconnecting means 146, however gas escape through the hole 158 is avoided by sealingly attaching one end of the tubular shaped bellows 152 around the hole 158, and by further attaching its other end 160 sealingly to the shaft that extends through that hole. Thus, gas enclosure 142 is fully sealed.

Inside gas enclosure 142 is displacer means 144 in the form of a conventional Stirling displacer piston. In brief terms, displacer means 144 simply comprises a cylinder that is closed at both ends and having the appropriate peripheral clearance between it and the inner diameter of power reciprocator 148 so that the entrapped gas can flow therearound as in known Stirling designs.

Interconnecting means 146 includes a crankshaft 162, connecting means for the power reciprocator in the form of connecting rods 164 and 166, and other connecting means for the displacer means in the form of a connecting rod 168. Connecting rod 168 is rigidly connected at its inboard end to displacer means 144, and on its outboard end it rigidly carries a Scotch yoke 170. Connecting rod 168 extends from displacer means 144 through opening 158, but as alluded to earlier, the integrity of the sealed gas enclosure is not violated because of the smaller bellows 152, yet relative reciprocation can and does take place between the displacer means and the power reciprocator because of the axial flexibility of bellows 152. Although described herein as a connecting rod, rod 168 could also be considered as an extension of, and therefore a part of, the displacer means 144 because it is rigidly rather than moveably connected thereto.

Crankshaft 162 includes a pair of identical cranks 172 and 174 separated by a center crank 176. Center crank 176 is disposed within the elongate slot 178 of Scotch yoke 170 to impart reciprocating motion to displacer means 144. Cranks 172 and 174 are less offset from the crankshaft axis (less "throw") than is crank 176, and they also subtend an appropriate angle relative to one another when viewed down the crankshaft centerline in keeping with conventional Stirling design philosophy. Cranks 172 and 174 are both pivotally attached to connecting rods 164 and 166, and connecting rods 164 and 166 are rigidly attached to the end wall 156 of power reciprocator 148. Connecting rods 164 and 166 can thus be considered as part of the power reciprocator or as part of the interconnecting means.

Because power reciprocator 148 and connecting rods 164 and 166 are rigidly connected together, and because connecting rods 164 and 166 are journaled on cranks 172 and 174, it will be understood that power reciprocator 148 will wobble slightly from front to rear as the crankshaft rotates. For example, in FIG. 9 it can be seen that power reciprocator 148 is leaning clockwise several degrees as cranks 172 and 174 are very close to one of their two extreme lateral positions. This wobble could be eliminated by incorporating another Scotch yoke at the crank end of each of the connecting rods 164 and 166, however there is virtually no possibility of the displacer means binding in the cylindrical body of the power reciprocator because all of the gas enclosure flexure causing the wobble is taken up by bellows 150 at the extreme heat source end of the gas enclosure.

By virtue of Scotch yoke 170, the fact that the connecting rod 168 is rigidly connected to displacer means 144, and also by virtue of the close fit of connecting rod 168 in hole 158, the connecting rod end of displacer means 144 remains fairly well centered within the cylindrical body of the power reciprocator. More accurate centering can be accomplished by the addition of a plurality of guides 180 around and along the length of displacer means 144, these being made of some suitable and low friction material such as Teflon.

The use of bellows 150 near the heat source allows connecting rods 164 and 166 to be rigidly connected to power reciprocator 148, and this in turn allows crankshaft 162 to be placed a relatively short outboard distance from end 156 of the power reciprocator. This outboard distance could be reduced considerably by replacing the smaller bellows 152 with a low profile sliding seal, but at the cost of pressure containment.

Excellent heat transfer is attained by placing the highly conductive and larger bellows adjacent the heat source, and rotary power is readily tapped from the outboard crankshaft 162. This embodiment also lends itself to placement of a flywheel (not shown) on the outboard crankshaft.

Referring now to FIGS. 10 and 11, shown there are internal means within the gas enclosure that change the path of the gas flow depending on whether it is traveling toward the expansion space or toward the compression space. These means comprise a modified displacer means designated here generally 182. Although this modified displacer means 182 is designed specifically to replace the displacer means 144 of FIGS. 9 and 10, the same concept is adaptable to either of the other two embodiments described earlier. Means 182 includes four equal size and elongate segments 184 of a cylinder which, when contracted together, form the solid appearing cylinder shown in FIG. 10. Attached internally thereto, and extending axially through the cylinder displacer means, is a special actuating shaft 186 that replaces the displacer-means-connecting-rod 168 of FIGS. 8 and 9.

Pivotally pinned to shaft 186 and disposed internally of segments 184 are a first set of links 188 and a second set of links 190 (see FIG. 12). Although set 188 is shown pivoted or extended fully outwardly from the shaft, and although set 190 is shown fully retracted or close to the shaft, both sets in fact pivot inwardly or outwardly together as a group. Shaft 186 is shown broken or separated between the two sets of links only for the purpose of showing the two limits of movement in a single drawing. Link sets 188 and 190 each carry at their outermost lateral extremities a plurality of pins 192 that pivotally connect the links to segments 184. When all of the links are contracted, as indicated by the configuration of links 190, displacer means segments 184 are similarly contracted according to their position in FIG. 10. This configuration results from the movement of the displacer means toward the compression space where the gas being compressed pushes against the displacer means causing links 188 and 190 to swing inwardly and contract segments 184. Thus, spent gas in the compression space flows back to the heating chamber around the displacer means. However, when the displacer piston moves toward the expansion space, the gas compressed therein pushes against the other end of the displacer means causing the links 188 and 190 to swing laterally outwardly and thereby spaced segments 184 to their configuration as seen in FIG. 11. In that configuration, with the segments 184 fully spread, the outer diameter of displacer means 182 is only slightly smaller than the inner diameter of the gas enclosure. Thus, the overwhelming bulk of the entrapped gas traveling from the expansion space to the compression space travels through the middle of the displacer means in longitudinal slots 194 which are created between segments 184 as a result of their separation.

In analyzing the effect of this gas flow path change, comparison will be made with early Stirling designs net incorporating regenerators. There, gas flowed in both directions around the displacer piston, thus engaging the inner sidewall of the gas enclosure both ways. This poses a problem. The heat source end of the gas enclosure is for heating entrapped gas, and the opposite end is for transforming the heated gas into mechanical work, but the mid-portions are primarily for the purpose of cooling spent gas traveling from the working chamber to the expansion space. If gas just heated in the heating chamber passes over the cooling portion of the gas enclosure sidewalls, not only is it prematurely sapped of some of its heat energy before reaching the working chamber, but its heating up of those sidewalls while on route to the working chamber diminishes the effectiveness of those cooling sidewalls thereafter when the spent gas moves back across them in its return to the expansion space. The improved displacer means design of FIGS. 10 through 12 avoids this ineptness. As mentioned earlier, appropriate design changes to the first and second mentioned embodiments would effect similar results, although admittedly the changes thereto would possibly be more complex.

The several embodiments shown and described have not included every detail of construction, particularly where those details were never intended to be claimed as part of the invention. For example, valves for the introduction of gas into the gas enclosures were not shown because such valves are well known and could be incorporated in a number of different locations. Also, techniques for making a seal hermetic is not the essence of this disclosure, but if one chooses to make the seals herein described hermetic, that technology is available in the literature.

One of the principal purposes underlying these teachings is to make the non-internal combustion engine a competitive and desireable alternative, and thereby help move power generation away from its dependence on irreplaceable energy sources such as oil. These engines will operate on any heat source or any fuel. In vehicular applications they can supply direct power or run generators to charge batteries for electric vehicles, on or off the vehicle. They can run on energy tapped from heat sources intended for other purposes such as furnaces, electric heaters, cooking ranges, animal body heat, charcoal pots, and so forth, or from environmental sources such as solar energy or thermal layers in the ocean or underground.

It is emphasized that many improvements have been described herein. Grouping several or more of these concepts does reap multiplied rewards in many cases, but this should in no way diminish the value of individual improvements when used alone in a given application.

It is quite likely that some of these improvements have an immediate application to engine styles or designs not mentioned herein, and future application to engines not yet conceived. This disclosure was detailed to ensure adequacy, but this detail should not be used to predjudice the underlying inventive concepts by imposing limitations not intended.

I claim:

1. A device incorporating the general principles of the Stirling cycle, comprising:

a gas enclosure containing an entrapped gas, said gas enclosure including both a base portion and a power reciprocator, said gas enclosure defining internally thereof a variable volume expansion space and a variable volume compression space;

flexible means sealingly connecting the base portion and the power reciprocator to minimize the escape of said entrapped gas between the base portion and the power reciprocator yet allow relative movement therebetween;

displacer means movably contained within said gas enclosure for moving said gaseous medium back and forth between said expansion space and said compression space;

and interconnecting means carried within said gas enclosure, said interconnecting means being connected both to said power reciprocator and to said displacer means for interrelating the movement of said power reciprocator and said displacer means generally in accordance with Stirling cycle characteristics.

2. The device defined in claim 1, wherein said flexible means comprises a bellows.

3. The device as defined in claim 1, wherein said interconnecting means is contained within said displacer means.

4. The device as defined in claim 1, wherein the gas enclosure is completely hermetically sealed whereby the gas contained therein has no path of escape except directly through the materials forming the gas enclosure.

5. The device as defined in claim 1, wherein the interconnecting means includes a cam, and also wherein said displacer means includes a cam follower, said follower being driven by said cam.

6. The device as defined in claim 1, wherein the interconnecting means includes a rotating shaft disposed in said heating chamber so as to be a significant distance from the power reciprocator.

7. The device as defined in claim 1, including means contained inside the gas enclosure for changing the path of the entrapped gas flow depending on whether it is traveling toward the expansion space or traveling toward the compression space.

8. The device as defined in claim 7, wherein said last mentioned means comprises linkage forming a part of the displacer means, whereby the external configuration of the displacer means changes to alternately effect gas flow around it and through it.

9. In an engine for converting heat energy to mechanical energy and characterized by a working-gas enclosure and a heat source external thereto, said gas enclosure including a base portion and a power reciprocator, the power reciprocator being connected to a crankshaft by way of connecting means, the improvement comprising:

both said crankshaft and said connecting means being contained inside the working-gas enclosure, said crankshaft being mounted for rotation therein, whereby the external dimensions of the resulting engine are less than if the crankshaft and connecting means were carried outside of the gas enclosure.

10. The improved engine as set forth in claim 9, wherein said working-gas enclosure also contains displacer means and other connecting means for connecting the displacer means to the crankshaft and for causing a Stirling cycle movement relationship between the power reciprocator and the displacer means.

11. The improved engine as set forth in claim 10, wherein said other connecting means comprises a cam on the crankshaft and a follower on the displacer means.

12. The improved engine as set forth in claim 10, wherein said displacer means includes mechanism to change its peripheral configuration responsive to the direction in which it is moving.

13. In a hot gas engine having a generally cylindrical gas enclosure including a base portion and a power reciprocator, said power reciprocator being driven back and forth axially of said enclosure by gas contained within said gas enclosure that is heated by an external source and not by internal combustion, said gas enclosure also containing movable displacer means that move back and forth between extreme axial ends of the gas enclosure, the improvement comprising:

flexible means in the form of a bellows having a fluted and generally cylindrical sidewall aligned axially with and sealingly connecting the power reciprocator to the base portion both for preventing the escape of gas outside of said gas enclosure between the power reciprocator and the base portion and also for permitting relative reciprocation between the base portion and the power reciprocator, said bellows both having an inner diameter greater than that of the displacer means and also being positioned between the extreme axial ends of the gas enclosure such that at least a portion of the displacer means reciprocates inside and between the bellows generally cylindrical sidewall.

14. The improved engine as defined in claim 13, wherein said displacer means divides the gas enclosure to define a variable volume expansion space and a variable volume compression space, the sidewall around one of said spaces being the fluted bellows sidewall, the engine conforming in operation to that of the Stirling cycle philosophy.

15. The improved engine as set forth in claim 13, wherein said flexible sealing means and said power reciprocator are integrally formed together of sheet metal to eliminate a potentially leaky joint therebetween.

16. The improved engine as defined in claim 13, wherein said gas enclosure contains a crankshaft internally connected to said power reciprocator.

17. The improved engine as defined in claim 16, wherein said gas enclosure also contains displacer means for moving the contained gas back and forth inside the gas enclosure, said crankshaft comprising a portion of interconnecting means fully contained within said gas enclosure for interrelating the movement of said power reciprocator and said displacer means in accordance with Stirling cycle design.

18. An improved Stirling cycle engine, comprising:

a generally elongate, cylindrical gas enclosure containing a gaseous medium and including both a base portion and a power reciprocator, said gas enclosure including internally therein both a variable volume expansion space and a variable volume compression space;

displacer means in the form generally of a piston wholly and moveably contained within said gas enclosure between said expansion space and said compression space for moving said gaseous medium back and forth between said expansion space and said compression space;

a bellows sealingly connection said base portion and said power reciprocator for preventing the escape of the gaseous medium out of the gas enclosure between the power reciprocator and the base portion and also for permitting relative reciprocation therebetween;

and interconnecting means wholly contained within said gas enclosure and interconnecting said power reciprocator and said displacer means for interrelating the reciprocating movement therebetween according to the general movement pattern of the Stirling cycle engine.

19. The improved Stirling cycle engine as set forth in claim 18; wherein said displacer means is hollow and has a hole at each end thereof, and further wherein said interconnecting means includes a crankshaft contained in said hollow displacer means, a stanchion connected to said base portion and extending through the hole in one end of the displacer means and connected to said crankshaft, a shaft extending through the hole in the other end of the displacer means connecting the power reciprocator to the crankshaft;

said crankshaft also being connected to said displacer means internally thereof, whereupon leakage of the gaseous medium is avoided and the volume inside the displacer means is utilized to reduce the external dimensions of the engine.

20. The improved Stirling cycle engine as set forth in claim 18, wherein said interconnecting means includes a crankshaft carried in one of said spaces of the gas enclosure so as to be an appreciable distance from the power reciprocator.

21. The improved Stirling cycle engine as set forth in claim 18, wherein said displacer means comprises a plurality of segments, said segments being so arranged as to expand the peripheral dimensions of the displacer means and expose an opening therethrough when the displacer means moves toward the expansion space, but contract the peripheral dimensions of the displacer means and close off said opening when the displacer means moves toward the compression space.

22. A Stirling cycle device, comprising:

a working-gas enclosure defined at least in part by a base portion, said working-gas enclosure being divided into two distinct and variable-volume spaces into which and out of which flows a gaseous medium;

a power reciprocator exposed to said gaseous medium and mounted for movement relative to said base portion for interaction with said gaseous medium;

and interconnecting means in moveable contact with said power reciprocator for interrelating the position of the power reciprocator relative to the flow of said gaseous medium into and out of said two spaces according to the Stirling cycle, said interconnecting means being contained within the working-gas enclosure to thereby reduce the overall size of said device.

23. The device as set forth in claim 22, wherein said power reciprocator is connected to said base portion by bellows for the purpose of assisting in the containment of said gaseous medium in said working-gas enclosure.

* * * * *

UNITED STATES PATENT AND TRADEMARK OFFICE

CERTIFICATE OF CORRECTION

PATENT NO. : 4,253,303

DATED : March 3, 1981

INVENTOR(S) : Jon L. Liljequist

It is certified that error appears in the above—identified patent and that said Letters Patent is hereby corrected as shown below:

Column 2, line 59, "Rinio" should be --Rinia--.

Signed and Sealed this

*Third* Day of *November 1981*

[SEAL]

*Attest:*

GERALD J. MOSSINGHOFF

*Attesting Officer*

*Commissioner of Patents and Trademarks*